United States Patent [19]

Solomon

[11] 4,282,398

[45] Aug. 4, 1981

[54] ANTI-HOLIDAY CABLE ARMOR

[76] Inventor: John H. Solomon, 7890 E. Spring St., Long Beach, Calif. 90813

[21] Appl. No.: 57,736

[22] Filed: Jul. 16, 1979

Related U.S. Application Data

[63] Continuation of Ser. No. 950,428, Oct. 11, 1978, abandoned.

[51] Int. Cl.[3] ..... H01B 7/22

[52] U.S. Cl. ..... 174/106 R; 174/109; 174/136; 57/235; 138/101; 138/130; 138/134; 156/190

[58] Field of Search ..... 174/106 R, 108, 109, 174/136; 138/130, 134, 100, 101; 156/53, 56, 188, 190; 57/15, 215, 230, 235

[56] References Cited

U.S. PATENT DOCUMENTS

| | | | |
|---|---|---|---|
| 1,987,794 | 1/1935 | Phillips | 174/109 |
| 2,087,373 | 7/1937 | Dodge | 138/134 X |
| 2,258,508 | 10/1941 | Kerchner | 174/109 X |
| 2,377,609 | 6/1945 | Brown | 57/235 |
| 2,531,917 | 11/1950 | Mollerhoj et al. | 174/106 R X |
| 2,536,243 | 1/1951 | Walker et al. | 138/101 |
| 3,334,177 | 8/1967 | Martin | 174/108 X |
| 3,357,456 | 12/1967 | Grawey et al. | 138/130 X |
| 3,810,803 | 5/1974 | Karp et al. | 156/190 |
| 4,187,389 | 2/1980 | Foote et al. | 156/53 X |

FOREIGN PATENT DOCUMENTS

| | | | |
|---|---|---|---|
| 58806 | 6/1941 | Denmark | 174/106 R |
| 2361181 | 6/1974 | Fed. Rep. of Germany | 138/130 |
| 7211793 | 3/1973 | Netherlands | 156/53 |
| 22005 | of 1906 | United Kingdom | 174/106 R |

*Primary Examiner*—Gene Z. Rubinson
*Assistant Examiner*—E. F. Borchelt
*Attorney, Agent, or Firm*—Knobbe, Martens, Olson, Hubbard & Bear

[57] ABSTRACT

An anti-holiday cable armor for submersible electrical cables comprising two generally helically wrapped, overlapping metal straps, the second metal strap being wrapped longitudinally, in a direction opposite to the direction of wrap on the first metal strap, for providing anti-holiday protection when the cable is pulled in either direction is disclosed.

2 Claims, 3 Drawing Figures

ANTI-HOLIDAY CABLE ARMOR

CROSS REFERENCE TO RELATED APPLICATION

This application is a continuation of my copending application Ser. No. 950,428, filed Oct. 11, 1978, entitled ARMOR COVERING FOR SUBMERSIBLE CABLE, now abandoned, to which priority is claimed.

TECHNICAL FIELD

This invention relates to electrical cables generally, and, specifically, to anti-holiday armor for electrical cables.

BACKGROUND ART

In many industries, in the oil industry in particular, it is necessary to provide cables which are armored to prevent damage to the cable during installation and use. Armored cables are also used in other environments where the cable is potentially subject to mechanical abuse. In the oil industry, electrical cables for down-hole pumps are particularly subject to mechanical abuse during insertion into and removal from the well. In this application, the pump is positioned in the well and the cable is pulled down the well to provide electrical energy to the pump at the bottom of the oil well. During this operation, the electrical cable is subject to being snagged by any number of objects in the oil well casing and in the machinery used to drop the down-hole pump into position. Frequently, it is necessary to lift the pump for servicing, access, or other treatment of the oil well. During this operation, the electrical cable which provides energy to the pump is pulled out of the well and is subject to being snagged in the other direction as it is pulled out of the casing. A failure in the armor of electrical cables is generally referred to in the art as a "holiday". The object of this invention is to provide an improved anti-holiday armor for cables generally and, specifically, for cables which are subject to being snagged in both directions, such as is the case in the oil well applications just described.

Armored cables are, of course, very well known. The following United States and foreign patents, the disclosure of which is incorporated herein by reference, teach various approachments and embodiments of armored cables:

U.S. Pat. No. 242,894 Delany June 14, 1881
U.S. Pat. No. 294,536 Waring Mar. 4, 1884
U.S. Pat. No. 327,476 Spalding Sept. 29, 1885
U.S. Pat. No. 916,741 Lutz Mar. 30, 1909
U.S. Pat. No. 1,937,054 Cremer et al Nov. 28, 1933
U.S. Pat. No. 2,453,313 Gordon Nov. 9, 1948
U.S. Pat. No. 2,531,917 Mollerhoj et al Nov. 28, 1950
U.S. Pat. No. 3,106,815 Nance et al Oct. 15, 1963
U.S. Pat. No. 3,334,177 Martin Aug. 1, 1967
U.S. Pat. No. 3,636,234 Wakefield Jan. 18, 1972
U.S. Pat. No. 3,742,363 Carle June 26, 1973
U.S. Pat. No. 3,773,109 Eberline Nov. 20, 1973
U.S. Pat. No. 3,834,481 Boyd et al Aug. 27, 1974
Denmark Pat. No. 58,806 June 16, 1941
Great Britain Pat. No. 22,005 Aug. 16, 1906
Great Britain Pat. No. 413,295 July 9, 1934

Delany, U.S. Pat. No. 242,894, and Waring, U.S. Pat. No. 294,536 each disclose the use of metal coverings on cables. Spalding, U.S. Pat. No. 327,476, teaches compound electrical cables which include multiple, parallel electrical connectors each enclosed in insulation and in metallic screen and all enclosed in additional metallic screen. Metal wrapped cables of various configurations are disclosed in Lutz, U.S. Pat. No. 916,741, Cremer et al, U.S. Pat. No. 1,937,054, Gordon, U.S. Pat. No. 2,453,313, and Mollerhoj et al, U.S. Pat. No. 2,531,917. Mollerhoj et al discloses a flat electrical cable around which are wrapped two thin metal tapes helically, one above the other. Other armored cables are disclosed in the afore-mentioned United States patents. Danish Pat. No. 58,806, to Standard Electric, discloses an electrical cable construction in which electrically insulated conductors are sequentially wrapped with two copper straps helically overlapping each other wound in one direction and a helically overlapping iron strap wound helically in the other direction, all three of the metal straps being wound from one end of the cable such that the metal straps all overlap the preceding helix in the same manner. The purpose for the metal wrapping in the standard electric Danish patent is not primarily as a mechanical armor and it would, at most, provide holiday protection in only one direction.

United Kingdom Pat. No. 22,005, Henley, discloses an electrical cable which is wrapped with two metallic ribbons from the same end of the cable, the first ribbon being wrapped helically in one direction from the first end of the cable and the second ribbon being wrapped helically in the opposite direction, but from the same end of the cable so that current flowing in the ribbons pass in a helically opposite direction. This arrangement would, inherently, provide some armoring effect but, at the most, would provide holiday protection in only one direction.

None of the prior art provides suitable anti-holiday protection in two directions for submersible cables and cables subjected to two-directional snagging. It is a principal feature of this invention to provide an improved electrical cable which overcomes the deficiencies of the prior art in this and other respects.

DISCLOSURE OF THE INVENTION

An electrical cable, which may include one or any number of electrical conductors surrounded individually or collectively by suitable electrical installation, with an improved metal armor providing two-directional anti-holiday protection is disclosed. The improved metal armor comprises a first metal strap in which one side, relative to the other side, is depressed, and the other side is raised, the two sides of the metal strap being joined by a transition bend. The metal strap is generally helically wrapped in a direction from the first end of the cable toward the second end of the cable such that the raised side of one wrap of the strap overlaps the lowered side of the next preceding wrap of the helix, to thus provide a non-snagging armor when the cable is pulled in one direction against a potentially snagging object. That is to say, when the cable is pulled in one direction against an object, the object slides smoothly along the armor from the overlapping, raised side of the helix onto the next overlapping, raised side of the helix in such a manner that it is impossible to engage an edge of the helix when the cable is moved relative to a potentially snagging object in one direction. Anti-holiday protection in the other direction is provided by wrapping the cable with the same type of metal strap directionally from the second end of the cable toward the first end of the cable in the same general manner with the raised side of the strap overlapping the lowered side of the strap of the next preceding wrap of the helix forming a non-snagging armor which provides anti-holiday protection when the cable is pulled in the opposite direction against a potentially snagging object. In the preferred embodiment, the cable is a flat, three-conductor cable, but any number of conductors and any shape of cable may be armored for anti-holiday protection in two directions in the manner described. Other specific features are more fully disclosed hereinafter.

BEST MODE FOR CARRYING OUT THE INVENTION

The preferred form of the present invention is a submersible cable which is generally flat, having a thickness of no more than about ½ the width of the cable. Such a cable is depicted at 10 in FIG. 1. The preferred form of cable will be used to illustrate, depict, and exemplify the invention but it will be understood that the invention is not limited to this type of cable. The invention is a two-directional anti-holiday armor which may be applicable to any type of cable. Typically, cables would include at least one electrical conductor enclosed by an insulator around which the armor would be formed. Obviously, multiple conductors, typically separated by individual insulating members and wrapped by a common insulating member, may be armored in the same way. A multiple conductor cable 10 having three conductors of which conductor 12 is typical comprises the exemplary embodiment of the invention. Each of the conductors is enclosed in an individual insulating member of which insulating sleeve 14 is typical. A common insulator 16 is typically formed to enclose a multiplicity of individually insulated conductors, the three insulated conductors depicted being merely exemplary. A two-directional anti-holiday armor is then formed by wrapping two, or more, layers of metal strap around the insulated conductors. The metal strap of the type utilized in this invention is known in the prior art. A first strap of this type is shown at 18 and a second such strap is shown at 20, both in FIG. 1.

Figure 1:
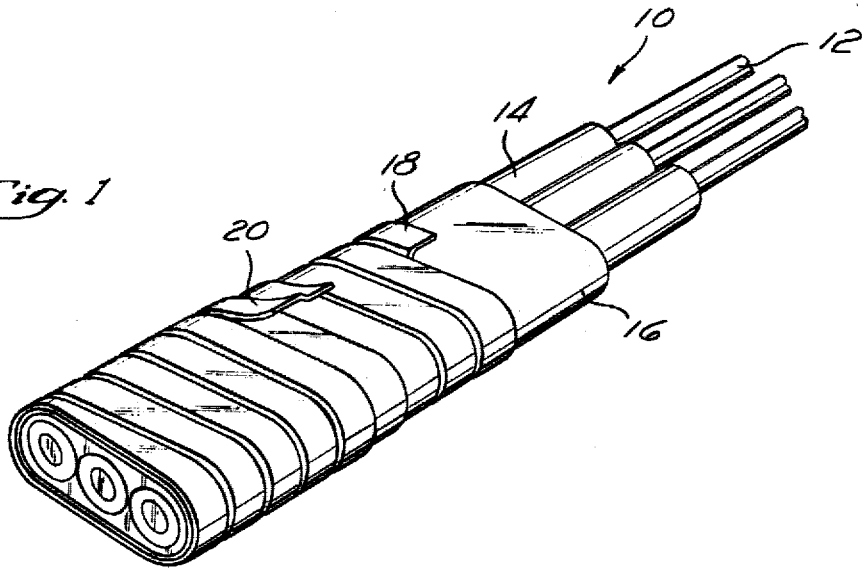
FIG. 1 is a perspective drawing of the cable of the present invention with various portions cut away to expose the conductor, insulation, and the two protective armor components of the cable.
Figure 2:
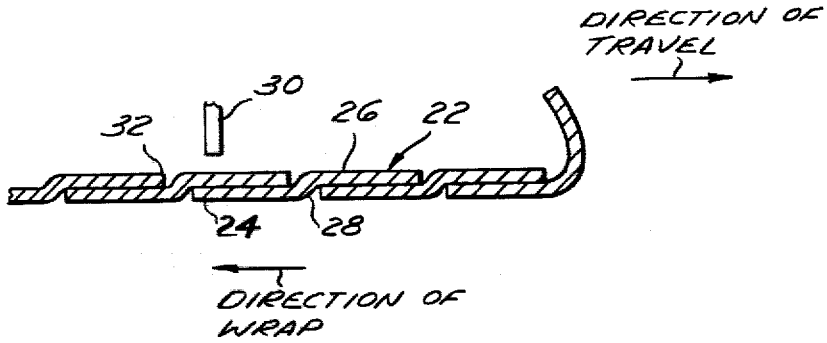
Fig. 2 (PRIOR ART)
FIG. 2 is a cross-sectional view taken longitudinally through a portion of a prior art armor cable formed of a metallic ribbon generally of the type used in the present invention.

The cross-sectional view of a prior art armor utilizing the same type of straps as are depicted at 18 and 20 in FIG. 1 and utilized in this invention is depicted in FIG. 2, to which reference is now made. In FIG. 2, the strap 22 is formed to have one edge 24 lowered or depressed relative to another edge 26 which is raised relative to the edge 24, the two edges or side portions 24 and 26 being joined by a transition bend 28. The relative width of the edge portions 24 and 26 and the width of the bend 28 are of no particular consequence and are not critical in this invention. The transition zone may, indeed, be formed during the wrapping operation simply by tightly wrapping a theretofore unformed metal strap. In the preferred embodiment, however, a metal strap is preformed in the manner described. The prior art armor depicted in 22 comprises only one wrap. To illustrate the manner of operation of the prior art, and the defect in the prior art, a potentially snagging object is indicated at 30 in FIG. 2. If the cable is moved to the left, as shown in FIG. 2, relative to the object 30, the object 30 will simply slide over the armor from the raised edge of the wrap forming the armor onto the next raised edge of the wrap forming the armor, and therefore will not snag and cause a break or holiday in the armor. However, if the cable armor of FIG. 2 is moved to the right, as shown in FIG. 2, relative to the potentially snagging object 30, the object 30 can engage the corner of the wrap indicated at 32 and tear the wrap open, thus causing a break in the armor and a holiday in the cable.

Figure 3:
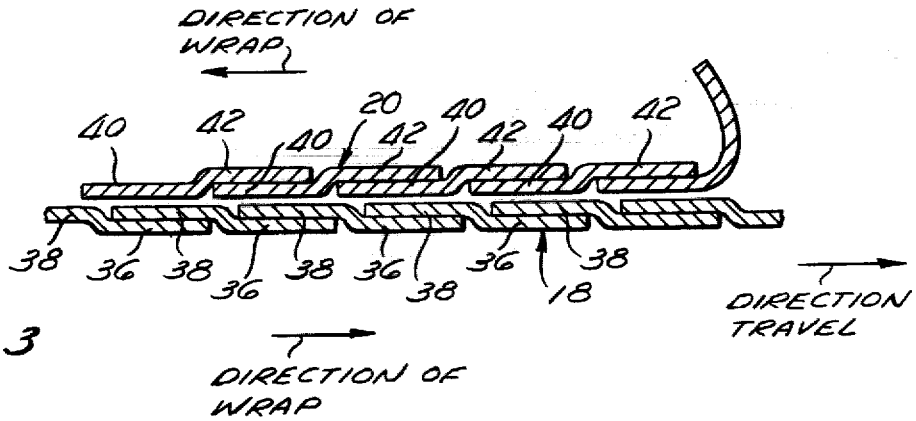
FIG. 3 is a partial cross-sectional view of the two-directional anti-holiday cable armor of this invention.

The reference is now made to FIG. 3 which depicts the two-directional anti-holiday armor of this invention. The first wrap of tape 18, which is shown in FIG. 1, is wrapped adjacent the insulating layer 16, is usually wrapped very tightly around the insulation, is formed such that a relatively lower side portion, indicated at 36, of the strap 18 is overlapped by the relatively raised portion, shown at 38, of the strap 18. This overlapping is repeatedly formed as the strap 18 is helically wrapped with the raised portion 38 always overlaying the lowered portion 36. This helical wrap is made from a direction from one end of the cable, at the left in FIG. 3, to the other end of the cable, to the right in FIG. 3, and provides unidirectional anti-holiday armoring for the cable.

Anti-holiday armoring in the other direction is provided by wrapping strap 20 helically from the second end of the cable, at the right in FIG. 3, toward the first end of the cable, at the left in FIG. 3, with the relatively lowered or depressed side portion 40 of the wrapping strap always underlying the relatively raised side portion, indicated at 42 of the strap, as the strap is helically wrapped in an overlapping manner in the opposite direction longitudinally of the cable. Thus, the cable can be moved relative to a potentially snagging object in either direction. In one direction, anti-holiday protection is provided by the first armor strap, and in the other direction anti-holiday protection is provided by the second armor strap.

As earlier pointed out, it is known to helically wrap multiple ribbons or tapes in different helical directions over a cable, usually to provide a balanced electrical field in the shield, but it has not heretofore been recognized that two directional anti-holiday armoring can be provided. Generally, also, it has been regarded as a very serious and grave disadvantage to have wrap cables in two longitudinal directions, it generally being preferred to form a cable in one continuous operation with multiple stations of wrapping or otherwise forming layers as the cable passes through each respective station.

A new result is accomplished by the coacting effect of the multiple longitudinally opposite wraps of armor according to this invention. This new result has not heretofore been accomplished in the electrical cable industry and derives from the unique and novel cooperation of the components in a way not heretofore contemplated.

Industrial Application

The two-directional anti-holiday armor of this invention is applicable to all heavy industrial electrical cables where installation or removal or use involves potential relative moving contact between the cable and a potential snag that finds its most common present application in the petroleum industry, for supplying electric power to submersible pumps.

I claim:

1. In an electrical cable of the type comprising at least one electrical conductor surrounded by at least one electrical insulating covering and a metal armor covering enclosing the insulating covering, the improvement wherein the metal armor covering is a two-directional anti-holiday armor comprising a first metal strap having a depressed side and a raised side generally helically wrapped directionally from the first end of the cable toward the second end of the cable with the raised side of the strap overlapping the depressed side of the strap of the next preceding wrap to the helix to provide a non-snagging armor when the cable is pulled on one direction against a potentially snagging object, and a second metal strap having a depressed side and a raised side generally helically wrapped directionally from the second end of the cable toward the first end of the cable with the raised side of the second strap overlapping the depressed side of the second strap of the next preceding wrap of the helix of the second metal strip to provide a non-snagging armor when the cable is pulled in the opposite direction against a potentially snagging object.

2. The electrical cable of claim 1 comprising three parallel electrical conductors lying generally in the same plane, each conductor individually enclosed in electrical insulation, and all three electrical conductors enclosed in electrical insulation, the metal armor overwrapping the last named electrical insulation thereby resulting in a generally flat electrical cable having a width at least about twice the thickness of the cable.

* * * * *